US006067829A

United States Patent [19]

Harmelin et al.

[11] Patent Number: 6,067,829

[45] Date of Patent: May 30, 2000

[54] WIRE-SPIRALLING MACHINE

[75] Inventors: Pascal Harmelin, Rouen; René Maloberti, Champigny sur Marne; Jean Guerin, Mont Saint Aignan, all of France

[73] Assignee: Coflexip, France

[21] Appl. No.: 09/284,814

[22] PCT Filed: Aug. 10, 1998

[86] PCT No.: PCT/FR98/01785

§ 371 Date: Apr. 21, 1999

§ 102(e) Date: Apr. 21, 1999

[87] PCT Pub. No.: WO99/10115

PCT Pub. Date: Mar. 4, 1999

[30] Foreign Application Priority Data

Aug. 22, 1997 [FR] France ..... 97 10584

[51] Int. Cl.[7] ..... B21C 37/12; B21F 3/02

[52] U.S. Cl. ..... 72/49; 72/135

[58] Field of Search ..... 72/50, 49, 51, 72/52, 146, 147, 148, 137, 135, 145, 142

[56] References Cited

U.S. PATENT DOCUMENTS

| | | | |
|---|---|---|---|
| 4,738,008 | 4/1988 | Proctor | 72/49 |
| 4,783,980 | 11/1988 | Varga | 72/49 |
| 4,895,011 | 1/1990 | Varga | 72/49 |

FOREIGN PATENT DOCUMENTS

| | | |
|---|---|---|
| 0019521 | 11/1980 | European Pat. Off. . |
| 2052057 | 4/1971 | France . |
| 2182372 | 12/1973 | France . |
| 2182532 | 12/1973 | France . |
| 0148061 | 7/1985 | France . |
| 61-235374 | 10/1986 | Japan . |

*Primary Examiner*—Rodney Butler

*Attorney, Agent, or Firm*—Ostrolenk, Faber, Gerb & Soffen, LLP

[57] ABSTRACT

A wire-spiralling machine continuously produces a tubular structure comprising a spiral winding, particularly a pressure-armor layer, from two noninterlocking wires of large cross section delivered from two reels of wire and two locking wires delivered from two reels of locking wire. A motorized rotating circular cage carries the four reels of wire and locking wire at its rear, while the downstream face of the cage supports, on two adjustable-inclination plates, two on-board twin-track caterpillars for dragging the wire. These caterpillars are arranged just upstream of guide and/or bend rolls leading the wires towards their respective lay point.

19 Claims, 12 Drawing Sheets

WIRE-SPIRALLING MACHINE

BACKGROUND OF THE INVENTION

The present invention relates to a device for continuously producing a tubular structure comprising a spiral winding made of at least one shaped wire of large cross section, particularly, although not exclusively, a noninterlocking wire delivered from a reel of wire and, as appropriate (that is to say when a noninterlocking wire is being used) at least one locking wire delivered from a reel of locking wire, which device will hereafter be known as a wire-spiralling machine.

The applicant company has developed and marketed for various applications, and particularly for offshore oil production, flexible tubular pipes which have high mechanical properties, particularly as regards the tensile strength and the ability to withstand the pressures exerted both from the outside of the pipe and from the inside, by the transported products particularly hydrocarbons.

Reference may, for example, be made to the patents EP-A-0,148,061 and EP-A-0,494,299, which disclose an example of a general structure for flexible tubular pipes, and a device for producing such a structure. In these two documents, the question is one of producing a tubular structure consisting of a spiral winding (generally the carcass of a flexible pipe) from an interlocking strip. The strip has a cross section, generally likenable to an S or a Z, which allows each laid turn to catch on to the previous turn by virtue of their complimenting profiles. In the former of these documents, a spiralling machine that is suitable for these relatively flexible strips is described. The machine comprises a circular plate rotating about a horizontal axis that coincides with the longitudinal axis of the tubular structure that is to be formed and which, on one same face where the laying of the spiral winding takes place, supports a strip-feed reel, guide rolls, a collection of shaping wheels and press rolls cooperating with a lay mandrel to form the turns of the winding. The same spiralling machine is discussed again in the second document, it being specified that it is possible simultaneously to use two reels paying out either two interlocking wires or one noninterlocking wire and an additional wire which produces the locking through combination with the first wire. A first alternative form of the device, inspired by document U.S. Pat. No. 4,783,980 is described, together with a second alternative form, inspired by document U.S. Pat. No. 4,895,011. In the latter alternative form, profiled strips are unwound from stationary supply reels and are wound externally into turns around the rotating plate, the innermost turn of this winding being taken over a turn roll to despatch the strips to the lay point.

There are also known flexible tubular pipes which comprise a metal reinforcing layer, such as an internal carcass or a layer which provides resistance to the internal or external pressure, known as the pressure-armour layer. The reinforcing layer consists of the spiral winding of an interlocking wire of the shaped wire type which has a solid cross section in the shape of a Z, such as the wires known by the name of "zeta". Documents FR-A-2,052,057 and FR-A-2,182,372 describe such windings, respectively of relatively thick wire wound at a short pitch and of wire of a flattened cross section wound at a large pitch, and the means for manufacturing then. These documents in particular comprise means for giving the wire a permanent sword-blade deformation prior to winding. The shaped wires involved in the techniques described in these two patents and in the current state of the art of wire spiralling have a thickness which at its maximum, is 10 mm or, exceptionally, is 12 mm.

Although the interlocking wires that consist of a strip of typically S- or Z-shaped cross section may prove satisfactory up to a certain level of forces or stresses involved, it has become apparent that in order to produce the carcasses or pressure-armour layers of flexible pipes, particularly of those intended for a more arduous environment (for example very high internal pressure, very deep water, very large diameter of flexible tube, high dynamic stressing), it was necessary to develop tubular structures produced by co-winding a noninterlocking wire with an additional element whose task was to catch the adjacent turns of noninterlocking wire together. The noninterlocking wire is advantageously a wire of the shaped wire kind, relatively thick, preferably of solid cross section comprising parts in relief. The cross section of the wire advantageously is in the shape of a T or a U rather than simply having a shaped strip in the case of a carcass or an S- or Z-shaped interlocking wire, in the case of a pressure-armour layer. The additional element, which hereafter will simply be called a locking wire, is for example U-shaped, or may even consist of a second wire of identical shape to the first, but arranged the opposite way round and wound around the first wire (straddling two adjacent turns of the first wire), if the catching reliefs of the shaped wire are designed for this. On this subject, reference will be made to EP-A-0,431,142 and WO-A-96/18060, the teachings of which are incorporated by reference. In the latter document, the manufacture of the spiral structure is merely touched upon: it is simply stated that the T-shaped wire can be spiralled in the same way as a noninterlocked wire of an additional pressure-armour layer or binding (that is to say one which generally consists of a flat. This is certainly possible in the case of T-shaped wires of relatively small cross section, the relatively low stiffness of which allows the wire to be routed and wound without particular problems of guidance, bending, unbending, etc. This becomes no longer true when the cross sections of the shaped wires are considerable and make the rigidity of the wire itself considerable-. By way of indication, the cross-sectional thickness of the Z-shaped interlocking steel wires used ranges from 4.8 mm to 10 mm, or even exceptionally 12 mm. The noninterlocking T-shaped wires specifically targeted by the invention are themselves 12 mm, 14 mm, 16 mm thick, or even thicker.

As far as the applicant company is aware, there does not yet exist any machine capable of correctly and automatically winding such wires, and this is therefore the subject of the present invention.

SUMMARY OF THE INVENTION

The invention proposes a device for continuously producing a tubular structure comprising a spiral winding made of at least one shaped wire of large cross section, particularly a wire that can be locked, especially a noninterlocking wire, delivered from a reel of wire and, as appropriate, at least one locking wire delivered from a reel of locking wire, comprising a motorized circular cage rotating about a horizontal axis with which the longitudinal axis of the tubular structure coincides, the tubular structure being formed at a lay point located near to the downstream face of the cage, and means of longitudinally dragging and of receiving the said tubular structure, in which device the reel of wire and, as appropriate, the reel of locking wire, are loaded on board and rotate with the cage, and the downstream face of the cage supports at least one onboard linear tensioner (that is to say a tensioning means acting on a linear section of wire) for dragging the wire delivered from the said reel of wire, interposed between the said reel and the point at which the structure is laid. Such a tensioning device has two parallel antagonistic gripping surfaces and is typically a tensioner comprising two tracks (known as a "twin-track caterpillar"), or possibly a collection of two opposed gangs of rollers. It should immediately be pointed out that the documents U.S. Pat. No. 4,783,980 and U.S. Pat. No. 4,895,011 mentioned earlier, disclose, on the rotating plate, motorized rollers for shaping the strip intended for winding, and that the rollers have merely to unwind without any appreciable effort other than that associated with the deformation that they impart to the strip. Such is not the case in the invention, where the object of the tensioner is to pull, advantageously in the regulated manner that will be seen later, the wire which comes from the upstream side of the cage at a very high tension given the cross sections of wire involved, and to deliver it downstream at an appropriate tension, which may either be chosen to be zero, or even negative (compression).

To bend the wire spiral it around the structure, rolls for guiding and/or bending the wire, which are supported by the downstream face of the cage, are interposed between the tensioner (the twin-track caterpillar, for example), and the lay point. One advantage of the proposed device is that it can work in two main modes, namely pulled wire or pushed wire or any other combination of these two modes. The expressions pulled wire or pushed wire mean at the lay point. When the wire is pulled, the wire receives from the tensioner a thrust which nonetheless leaves the wire in tension downstream of the tensioner. When the wire is pushed, the wire receives from the tensioner a sufficient push that downstream, the longitudinal force is close to zero or in any case positive in order to ensure the geometric stability in the turns of the winding. In the case of the pulled wire the rolls mentioned earlier are essentially bend rolls (simple rolls inside the loop of wire downstream of the tensioner), and in the case of the pushed wire these are, with the exception of the last press rolls, essentially guide rolls (double rolls framing the wire), it being understood that at the lay point they are always bend and/or press rolls which also serve for bending in the case of pushed wire.

Advantageously, in the case of the pulled wire, a position sensor is provided on the path of the wire between the tensioner (the twin-track caterpillar for example) and the unbending/guide rolls, to guide the speed at which the tensioner is driven so that the tension of the wire downstream of the tensioner remains within a preset range.

In the most general case in which the device of the invention is used for constructing the pressure-armour layer of a flexible pipe, the cage has a central passage through which there passes the flexible tube at the periphery of which the shaped wire that forms the pressure-armour layer is laid.

Advantageously, the cage is secured on its upstream face to a coaxial tube which supports the reel or reels of wire and the reel or reels of locking wire.

The cage then advantageously has openings for the passage of the wire and of the locking wire from its upstream face to its downstream face.

As a preference, in order to allow the loop of wire which will be wound to lie substantially within the osculating plane of the spiral winding at the lay point, the cage on its downstream face has at least one plate which is inclined thereto for supporting the tensioner and members in contact with the wire, which are interposed between the tensioner and the lay point (namely, in particular, the guide and/or bend rolls), so that from where it passes the tensioner, the wire is deformed only by simple curving, that is to say bending in a plane which is the osculating plane, with the exclusion of any other deformation such as torsion or edgewise bending.

In the preferred embodiment of the invention, there are two wires and two tensioners in particular two corresponding twin-track caterpillars, each borne by one of two plates inclined in opposite directions, in two configurations which are symmetric with respect to the axis of the machine. In this case, there are also two reels of locking wire.

Advantageously, each plate is in the shape of a crescent partially surrounding the said tubular structure over at least 180°, the ends of the two crescents nestling together in such a way as to envelop the flexible tube as two symmetric sectors, preferably exceeding or equal to 90°.

As a preference, the inclination of the plate or plates is adjustable, for example between 0 and 10° so that windings can be made at several possible helix angles, depending on the cross section of the wires and the diameter of the tubular structure.

In one use of the spiralling machine with pulled wire, in which, given the rigidity of the wire and the need to pass it through various bending/unbending systems between the feed reels and the downstream face of the cage, the tension exerted on the wire at the downstream face of the cage is of the order of 4 tonnes or more, the on-board twin-track caterpillar in accordance with the invention allow the tension in the length of wire downstream to be returned to a reasonable value, controlled in order to remain within a given range, making it possible not to damage the flexible tube (plastic sheaths) on which winding is performed, the tension in the wire giving rise to a force that crushes the internal layers of the flexible tube onto which layers the wire is wound.

The wire and the machine in accordance with the present invention are used without any edgewise prebending. The inclination, preferably adjustable, of the plates bearing the twin-track caterpillars allows this winding without edgewise bending, that is to say without imposing plastic deformations on the edge of the wire (sword-blade deformations), which deformations would be detrimental to the correct winding at the lay point. In this context, there is a significant difference from windings of S- or Z-shaped interlocking wires, in which the tiling phenomenon could be avoided only by exerting controlled edgewise bending on the wire prior to winding it.

The cage is driven by a powerful drive element (for example of the order of 250 kW). As its inertia is considerable (the on-board mass, namely the cage itself and the rest of the rotating gear is some 100 tonnes, that is to say of the order of ten times the on-board mass in conventional spiralling machines), it is particularly advantageous to use the inertia of the cage as a store of energy in the event of the main energy supply being interrupted, so as to redistribute it to the auxiliary motors, particularly those of the twin-track caterpillars (which have a power of about 90 kW), which are driven by electrified shafts, this being in order not to damage the flexible tube in the event of a sudden stoppage (loss of current).

Advantageously the machine of the invention is associated with an installation for conditioning the reels of shaped wire, in which installation the T-shaped wire is correctly prebent (in particular to prevent a tendency to unwind from the reel) and guided.

The spiralling machine itself comprises, downstream of the reels, a guiding and straightening (unbending) device, the guiding device being disengaged in normal operation; if need be, the machine can operate in the opposite direction, rewinding the wire onto the reel after bending and guiding.

As has been stated, the spiralling machine of the invention is primarily designed to work with two pulled shaped wires and two pulled locking wires for a typical application to a pressure-armour layer for a "rough bore" pipe described in document API17B "Recommended practice for flexible pipes" published on Jun. 1, 1988. The speed of the twin-track caterpillars is slaved to the tension of the wire in its shaping loop between the twin-track caterpillar and the lay point.

In a second operating mode, particularly for a typical application to a pressure-armour layer for a "smooth bore" pipe (see the same document API17B), the spiralling machine works with two pushed shaped wires and two pulled locking wires. The speed of the twin-track caterpillars is slaved to the rotational speed of the cage.

In another operating mode that combines the previous two, the spiralling machine works with a pushed shaped wire, placed with its back towards the inside of the pipe, and a pulled wire arranged with its back facing outwards, which catches around the adjacent turns of the pushed wire. This operating mode can be used to produce a carcass or alternatively to produce a pressure-armour layer. In the latter instance, the other two reels, which do not need to carry locking wire, can be used to carry the wire commonly known as binding wire, the spiralling machine of the invention thus allowing the pressure-armour layer and the binding layer to be produced in a single pass.

BRIEF DESCRIPTION OF THE DRAWINGS

The invention will be better understood by virtue of the following description, which makes reference to the appended drawings, in which.

DETAILED DESCRIPTION OF THE PREFERRED EMBODIMENT

One example of a flexible tubular pipe which can be manufactured by means of the invention will be described first of all, with reference to FIGS. 12 and 13.

Figure 12:
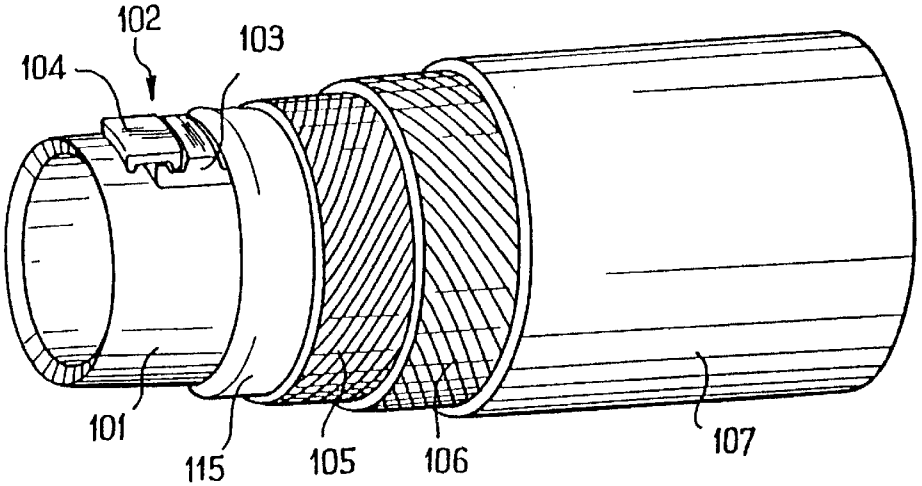
FIG. 12 is a diagrammatic view of one example of a flexible tubular pipe, some of the elements, such as the pressure-armour layer, of which may be produced by the wire-spiralling machine of the invention, FIG. 13 more specifically illustrates one example of the pressure-armour layer of the pipe of FIG. 12.

FIG. 12 shows a pipe of the smooth bore type (with a smooth internal passage) comprising, from the inside outwards, a plastic sealing sheath 101, particularly made of polyamide, fluorinated polymer or cross-linked polyethylene; a pressure-armour layer 102 including of a spiral winding of a T-shaped wire 103 and of a U-shaped locking wire 104, or alternatively of the interlocking winding of two shaped wires 103 and two locking wires 104, the pitch of the helixes formed by each wire then being twice as long as in the previous instance; as appropriate, an intermediate sheath 115; a tensile armour layer having two crossed layers of metal wires 105, 106, and an outer sealing sheath 107.

Figure 13:
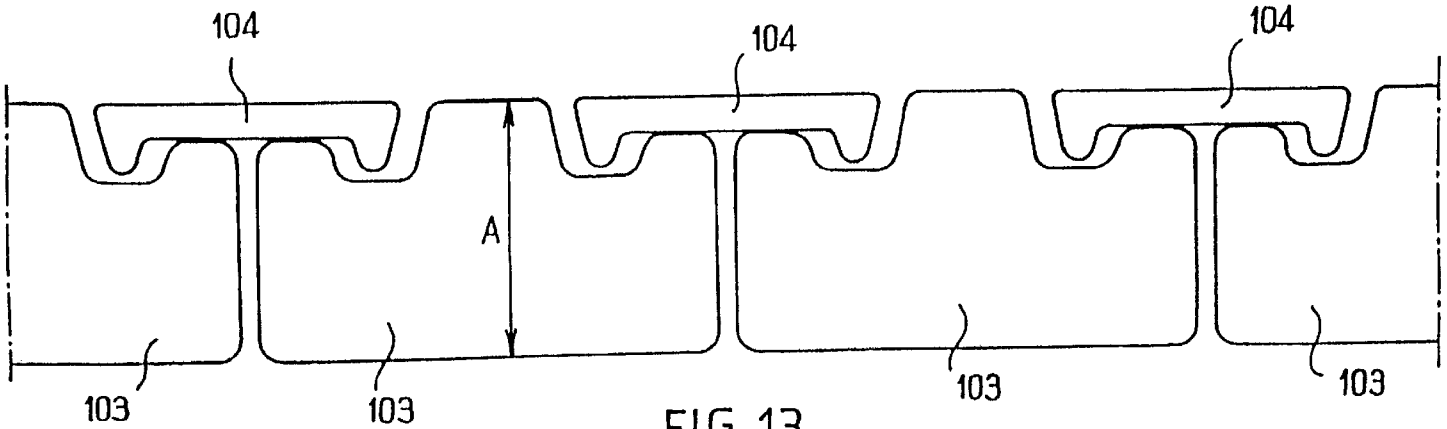

FIG. 13 shows the consecutive turns of shaped wire 103 and of locking wire 104 in greater detail. The cross section of the wire 103 is in the shape of a T with a thick bar facing outwards, the bar of the T being on the inside of the winding, the T having a fairly short central leg and two lateral projections which are even shorter still on the same side of the bar of the T. For wires having a large cross section, the height A (or thickness) is of the order of 12 mm, 14 mm, 16 mm or more. Two adjacent T-shaped turns are locked together by a locking wire 104 of essentially U-shaped cross section (inverted in FIG. 13) with short legs. For more details regarding the shapes and dimensions of the wires, reference can be made to the document WO-A-96/18060 already mentioned. The wires with which the invention is concerned are not, however, specifically restricted to the T-shapes described in this document. In general, the invention is particularly beneficial for all noninterlocking wires of large cross section, that is to say ones usually characterized by planar symmetry and an absence of axial symmetry (unlike the S- or Z-shaped interlocking wires), without these geometric considerations restricting the scope of the applications of the invention, particularly given the fact that the machine can also be used for winding interlocking wires or noninterlocking wires, for example wires of rectangular cross section such as the wires used to form the reinforcing layers known as binding layers.

The wire-spiralling machine which will now be described, particularly with reference to FIGS. 1 to 10, is primarily intended for producing the pressure-armour layer 102 around the sheath 101 of the pipe described previously, from two shaped wires and two locking wires, but as will be seen later, it may be used for producing other types of winding.

Hereafter, the term flexible tube 2 will be used to denote the tubular element which has to be produced at least partially by winding, irrespective of its stage of manufacture, possibly making the distinction where necessary between the flexible tube 2' prior to winding (this then, for example, is merely inner sheath 101), and the flexible tube after winding 2" (this then, for example, is the combination of the sheath 101 and of the pressure-armour layer 102).

The spiralling machine 1 for winding the flexible tube 2 comprises an upstream part 3, via which the flexible tube 2' to be covered arrives, a main active part which includes of a rotating assembly 4, and a downstream part 5 via which the covered flexible tube 2" exits.

Various runs of decking provide access to and around the machine, particularly the welding decking 6, on the side of the rotating assembly 4, and the downstream decking 7 for visually inspecting the winding or other operations.

Figure 1:
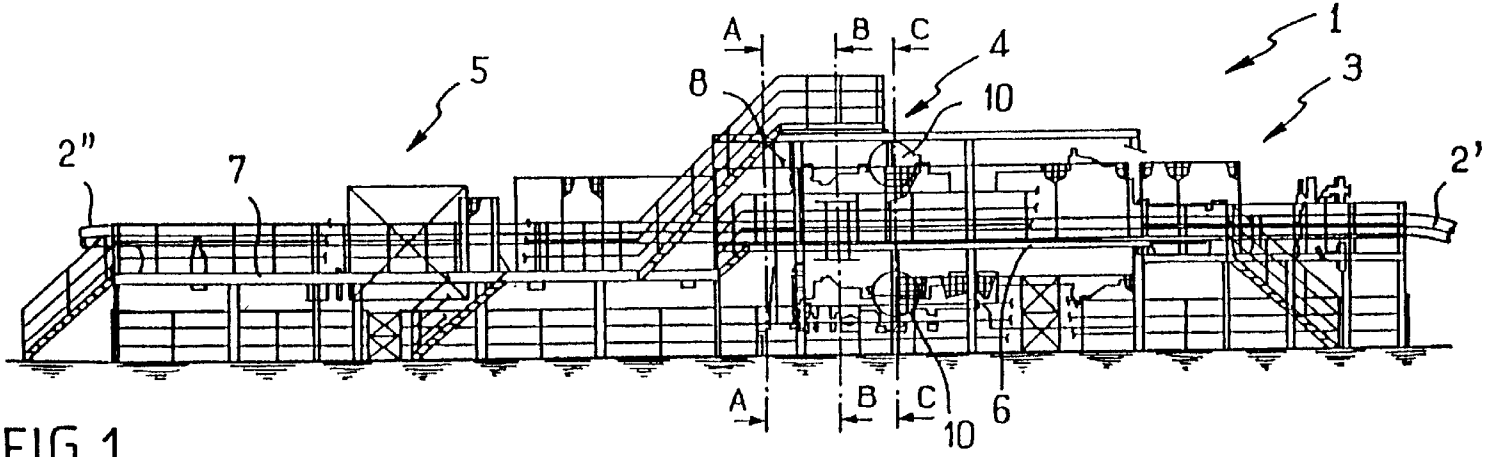
FIG. 1 is an elevation of the wire spiralling machine in accordance with one embodiment of the invention.
Figure 2:
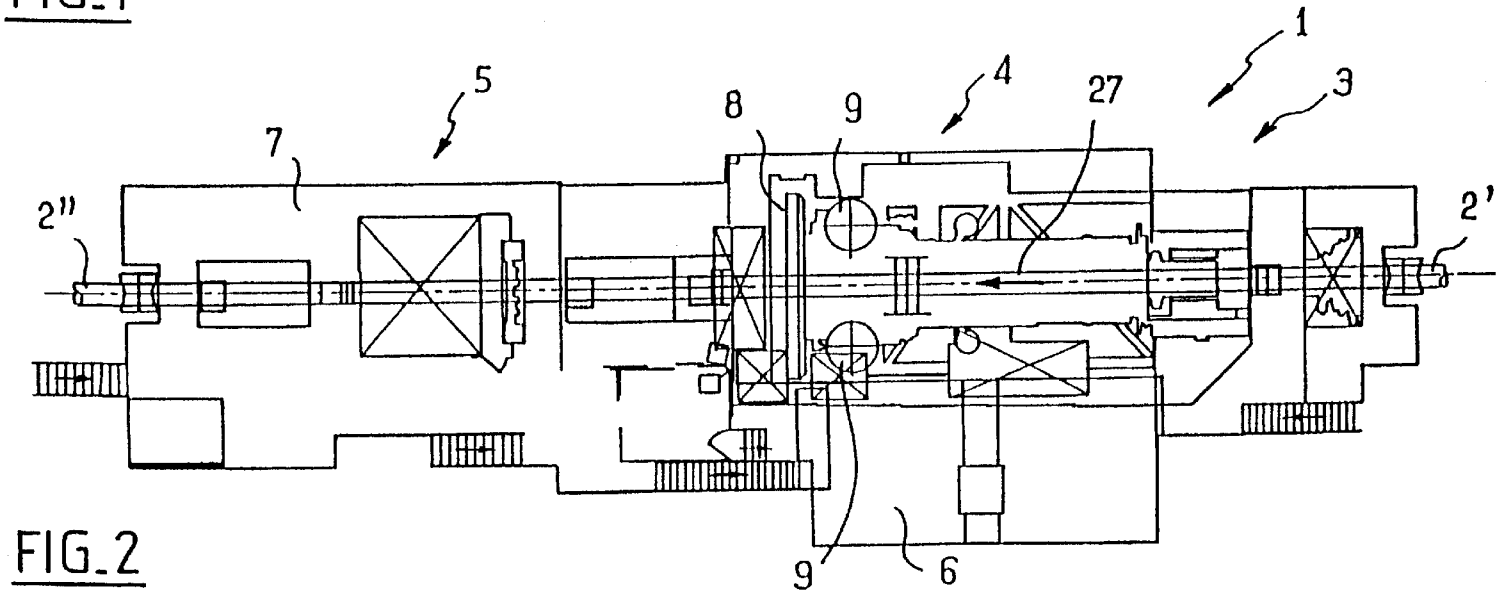
FIG. 2 depicts the same machine, in plan view.
Figure 3:
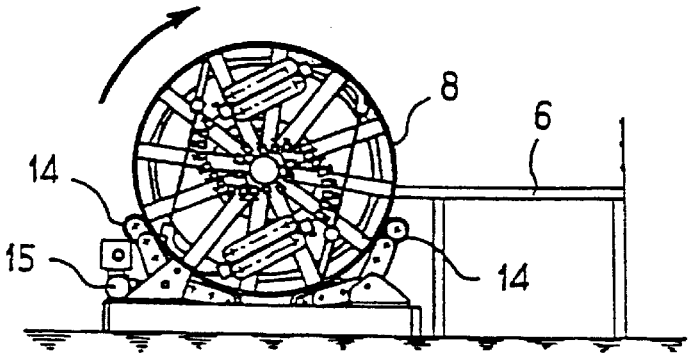
FIG. 3 is a section on A—A of FIG. 1.
Figure 4:
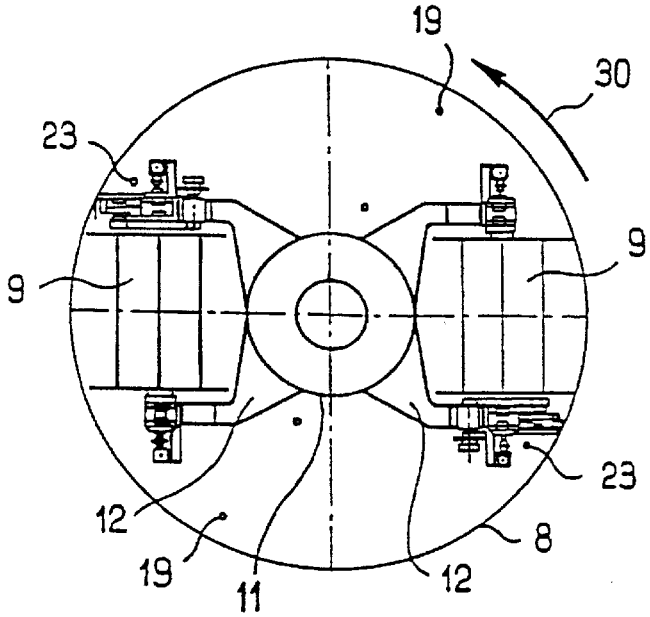
FIG. 4 is a section on B—B of FIG. 1.
Figure 5:
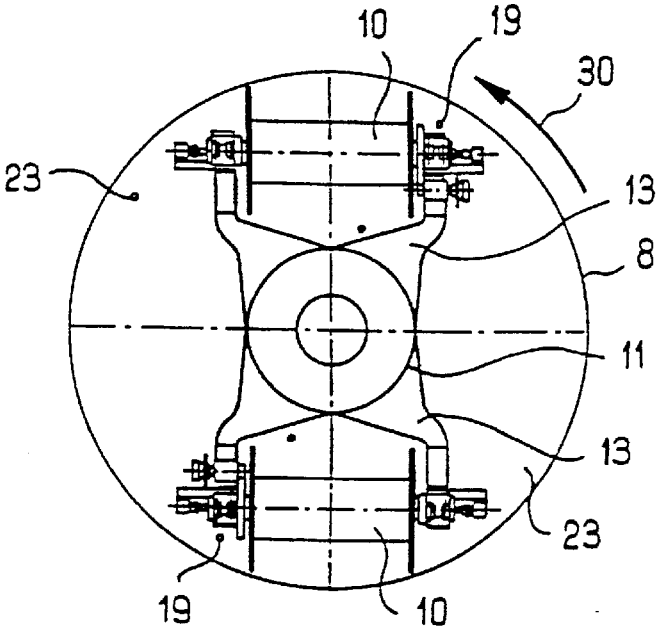
FIG. 5 is a section on C—C of FIG. 1.
Figure 6:
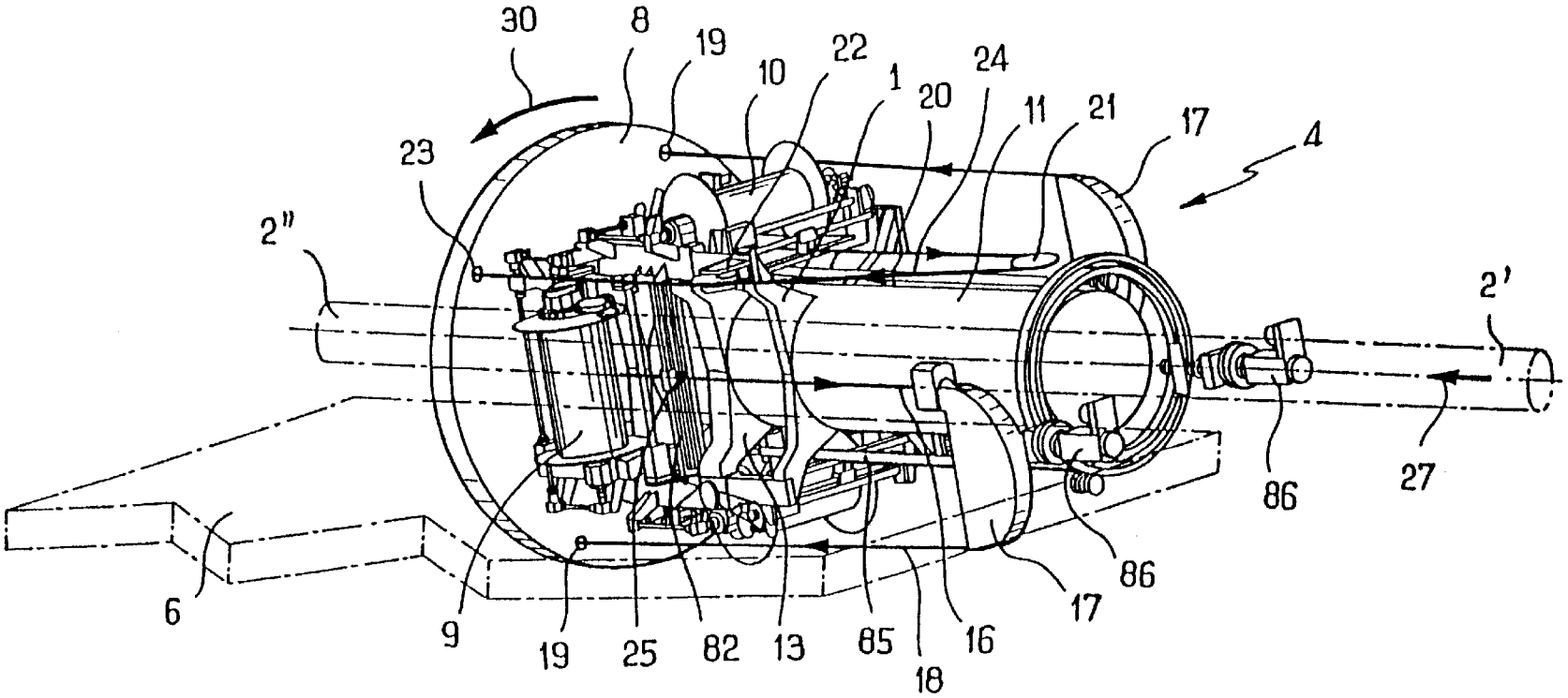
FIG. 6 is a rear-side perspective view of the entire rotating part of the wire-spiralling machine of FIG. 1.
Figure 7:
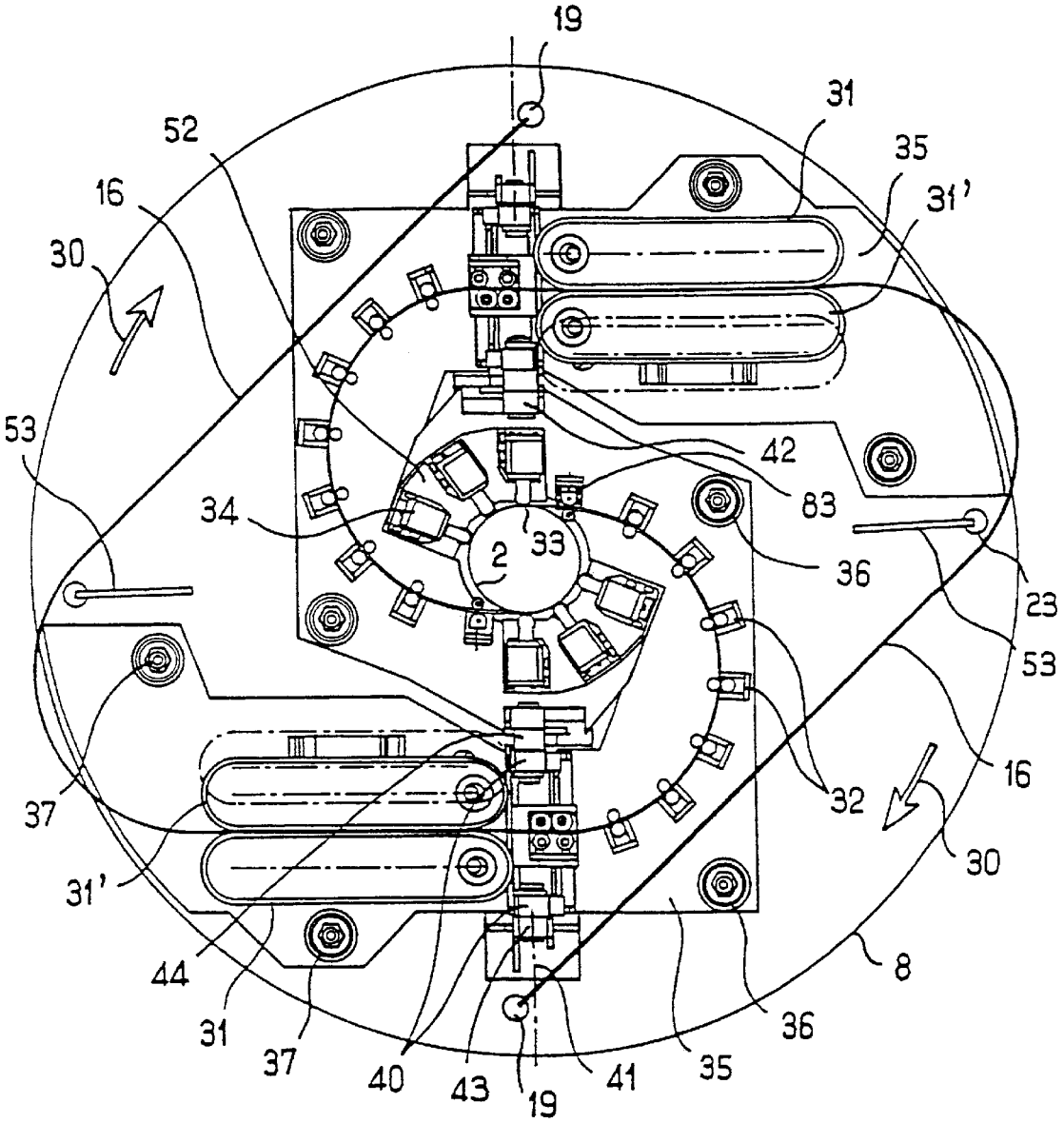
FIG. 7 is a front view of the cage of the wire-spiralling machine, equipped for pushed wires.

The rotating assembly 4 is essentially made up of a rotating cage 8, upstream of which there are two motorized on-board reels of wire 9, diametrically opposed, and two motorized on-board reels of locking wire 10, diametrically opposed on a diameter at right angles to that of the reels of wire 9 (FIGS. 1, 2 and 6).

The cage 8 is secured, upstream of its axis, to a solid central tube 11 on which the supports 12 for the reels 9 of wire and the supports 13 for the reels of locking wire 10 are mounted. The supports 12 and 13 are in the form of clevis blocks (FIGS. 4, 5 and 6) and also support the reel motors, used as brakes for normal spiral winding, and as motors when rewinding onto the reels in the event of unspiralling.

The cage 8 rests on a cradle of idling rolls 14 (FIG. 3) and is driven, for example, by a main motor unit 15, via an articulated shaft connected to the said motor 15, pinions and a crown wheel, none of which are depicted.

To avoid excessive tension in the wire 16, mainly during machine stoppages, there are accumulator loops kept taut by rams (units which for simplicity will be called accumulators), limiting the tension in the wire 16 to 1 tonne (for example). To limit the radial bulk of the rotating assembly 4, these accumulators and their rams (not depicted in FIG. 6 but shown schematically by the reference 80 in FIG. 15) are arranged parallel to the axis of the cage 8, upstream thereof. Thus, the wire 16 which is paid out from the on-board reels of wire 9 is despatched first of all backwards over a turner 17 (which advantageously consists of an arc of rolls preceded by bend rollers and followed by unbending rollers) so as to form an accumulated loop 18 of wire, before being despatched downstream, that is to say towards the cage 8 through which it passes through openings 19 formed for this purpose. The length of the loop 18 of wire 16 can be adjusted by making the turner 17 slide axially, using the rams of the accumulator. Note the layout of the turners 17 tangential to the rotating assembly 4, with the intention of limiting the radial size. Given the longitudinal arrangements of the accumulators and tangential arrangements of the turners 17, it is necessary to twist the wire 16 in one direction followed by a twisting of the wire in the other direction, at 90°; these deformations are performed without exceeding the yield stress, which implies a lengthening of the rotating assembly 4 (tube 11).

A similar device allows the locking wires 20 to be paid out and turned, using a turner 21 (comprising for example, of a simple pulley) mounted on longitudinal rams (see reference 81, FIG. 16), forming a loop 24 of locking wire, a guide pulley 22, and an opening 23 passing through the cage 8.

Just after they have been paid out from the reels 9, the wires undergo unbending through unbending rolls 25, which can be reversed to form bending rolls. The wire-unbending rolls 25 are associated with disengageable guides 82 which cause them to move transversely back and forth. When the wire-spiralling machine is in normal use, the guides are in a floating position; they are only brought into a motorized engaged position if unspiralling is to be performed. The bending/unbending rolls 25 are always active, that is to say they are active both when spiralling and when unspiralling.

The flexible tube 2' passes through the tube 11 from upstream to downstream, by virtue of conventional drive means, not depicted (for example twin-track caterpillars arranged upstream and downstream of the spiralling machine). The direction of travel is indicated by the arrow 27 (FIGS. 2 and 6).

The structure and operation of the downstream part of the wire-spiralling machine mounted, in this case, for spiralling pushed wires, will now be described in greater detail, with particular reference to FIGS. 7 to 10.

During spiralling, the cage 8 rotates in the direction of the arrows 30 to simultaneously spiral around the flexible tube 2 the wires 16 which are passed through the cage 8 through the openings 19. The wires 16 are taken up between the face-to-face grousers of two twin-track caterpillars 31, 31', from where they emerge essentially at right angles to a diametral plane (in fact with a small adjustable angle as will be seen later) of the cage 8 (the vertical diametral plane in FIG. 7) to be taken up in a set of conveying rolls 32 aligned in a curve (substantially a semi-circle) allowing each wire to be brought substantially tangentially to its respective point 33 at which it is laid onto the flexible tube 2, after passing between bend rolls 83 located close to the lay point. The pushed wire just laid on the flexible tube is held there and bent during the start of the formation of the turn by three press rolls 34 downstream of the lay point 33.

In order to bring the wire as exactly as possible into the osculating plane of the helix being formed, the osculating plane is defined at the lay point, each of the two assemblies for conveying the wire 16, that is to say the twin-track caterpillar 31, 31' and the rolls 32, 83 and 34, is mounted on an independent plate 35 oriented obliquely with respect to a plane perpendicular to the axis of the cage 8, this orientation being adjustable.

Figure 8:
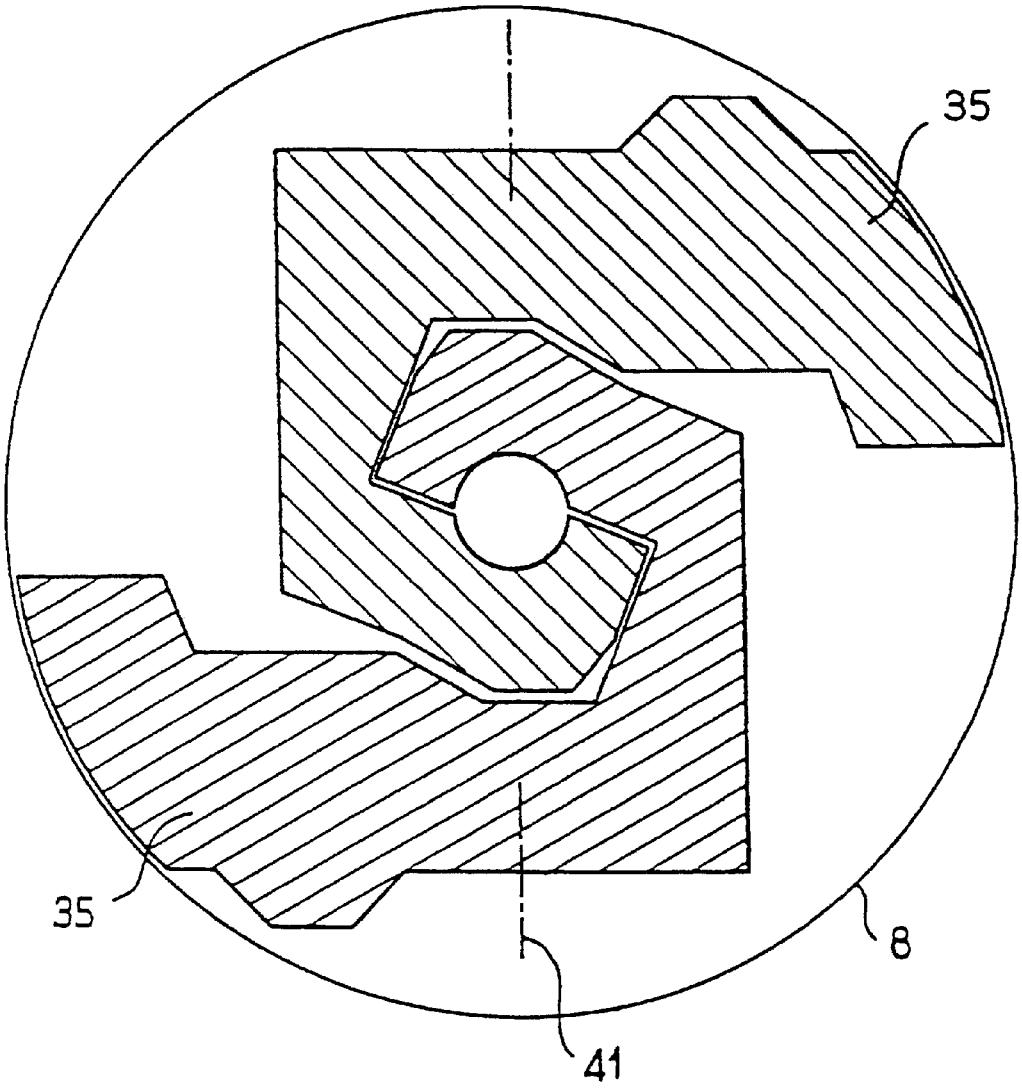
FIG. 8 is a diagrammatic end-on view of the cage of the wire spiralling machine, showing the respective arrangement of the two inclinable plates.
Figure 9:
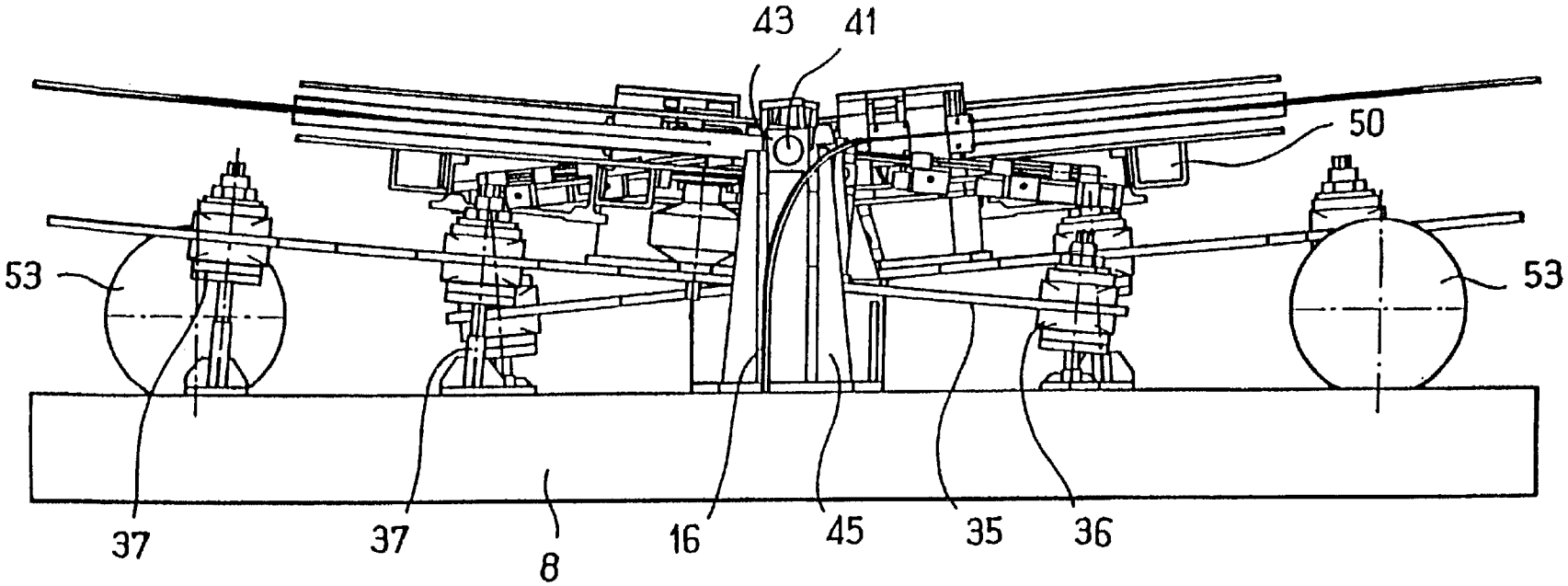
FIG. 9 is a side view of the cage of the wire-spiralling machine, equipped for pushed wires.
Figure 10:
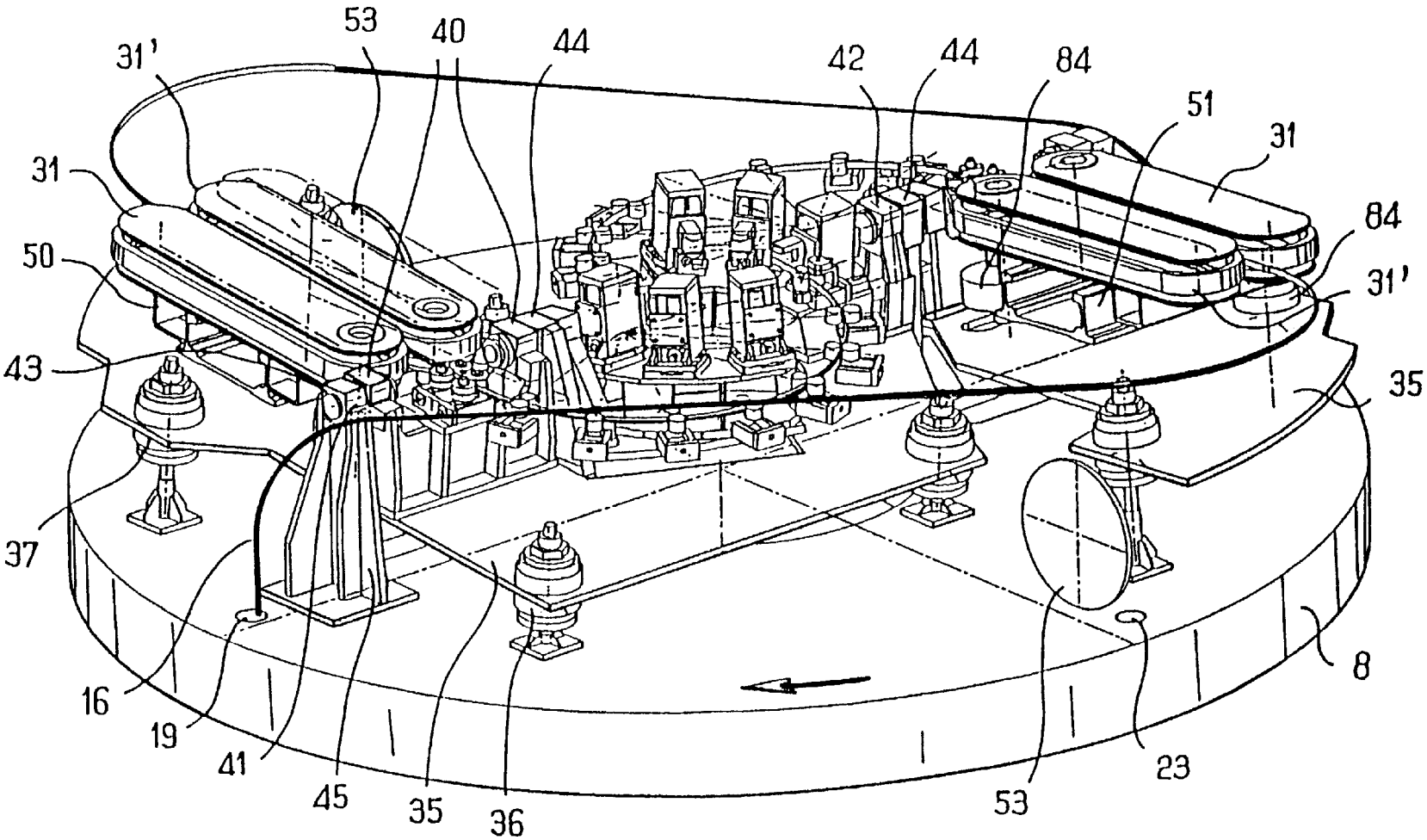
FIG. 10 is a side perspective view of the same spiralling-machine cage, equipped for pushed wires.

The crescent shape of the two plates 35, which can best be seen in diagrammatic plane view in FIG. 8, is such that they nestle together near the centre of the cage 8. Each crescent surrounds flexible tube 2' over at least 180°. The ends of the crescents nestle together so that they envelop flexible tube 2' as two symmetric sectors, preferably exceeding 90°.

Each plate is mounted by means of two bearings 40 and one bearing 42 situated on each side of the central portion of the plate, rotating on an axis of articulation 41 parallel to the cage 8 and a short distance from the downstream face thereof. The axis 41 is physically embodied by in-line shafts swivelling in bearings 43 and 44 borne by brackets 45 fixed to the downstream face of the cage 8.

The opposite edges of each plate 35, on each side of the axis of articulation 41, are connected to rams 36 and 37 fixed to the downstream face of the cage 8. The rams 36, located closest to the axis of the cage 8, are shorter than the rams 37, which are further from the axis, so as to give the plate 35 they bear the desired inclination, notably an inclination parallel to or close to that of the osculating plane of the winding desired at the lay point. Instead of these four rams acting on the single degree of freedom given to the plate by the articulation, other ways of inclining the plates are possible.

The track 31 is mounted so that it is stationary, while its counterpart 31' is mounted on supports 50 themselves mounted on elements 51 that slide in rests secured to the plate 35 in its relatively peripheral part. By sliding, the track 31' can adopt the position depicted in dotted line in FIG. 7, so as to open the twin-track caterpillar 31, 31' up so that the wire 16 can be installed in it. The two shafts 84 of the tracks 31, 31' pass through the plate 35 through openings that are compatible with the sliding of the track 31', and also pass through the cage 8, on the upstream face of which they are connected by a splitter to one and the same drive shaft 85 (FIG. 6) arranged along the tube 11 and rotating with it; each of the two shafts 85 is driven via crown wheels and pinions of a twin-track motor 86 mounted stationary at the rear of the wire-spiralling machine.

The three press rolls 34 are mounted on a small plate 52.

The auxiliary devices for guiding the wire 16 between the opening 19 and the entry into the twin-track caterpillar 31, 31' have not been depicted in these figures. These devices may comprise guide rolls and twisting/untwisting devices (see, for example, reference 87 in FIG. 15).

FIGS. 7 to 10 again show the openings 23 for the passage of the locking wire, near to which openings there is a guide pulley 53 turning the locking wire back towards the lay point 33.

Figure 11:
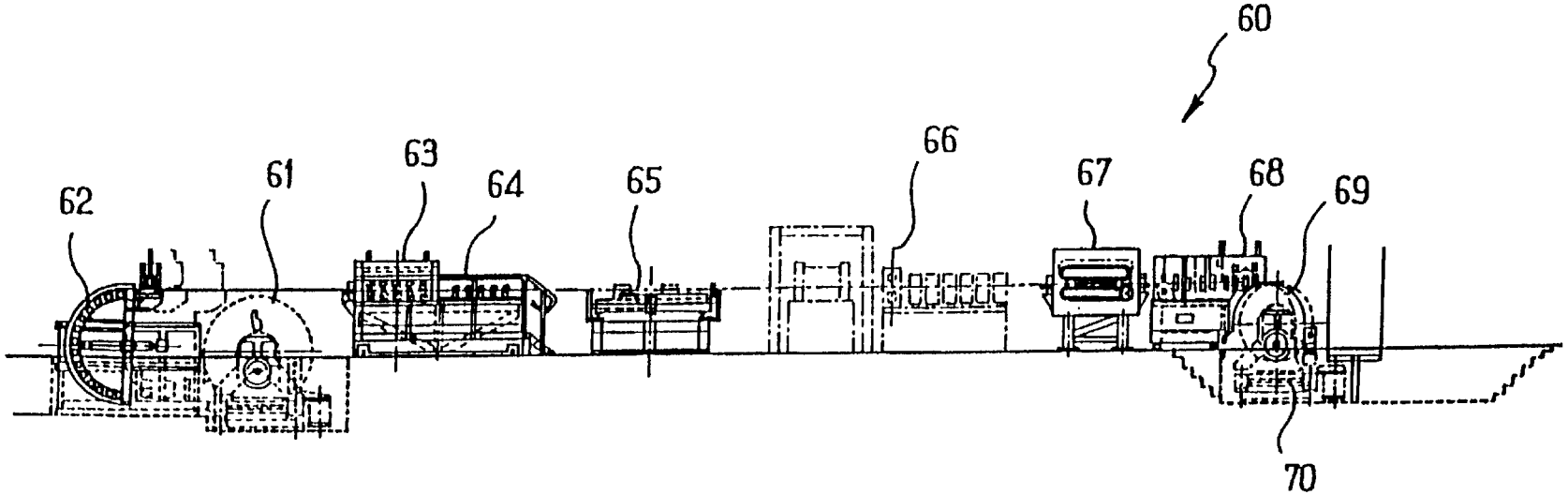
FIG. 11 is an elevation of an installation for preparing the wire that is to be spiral-wound.

FIG. 11 depicts an installation 60 for preparing the reels 9 of wire intended for the spiralling machine. The installation comprises a reel 61 for paying out commercial wound wire, which pays out the wire backwards over a semi-circle 62 of accumulator rolls allowing an adjustable-length loop to-be formed. The wire is despatched forwards to be straightened out flat and on edge through a flat straightener 63 and edge straightener 64, the wire being pulled by a stepping pulling device 65 and a twin-track caterpillar 67. The wire then passes through a bender 68 (set of bend rolls) before being wound under tension and with correct guidance over a receiving reel 69 driven by a winch 70. There may be a welding installation 66 interposed between the device 35 and the twin-track caterpillar 67.

The way in which the wire-spiralling machine of the invention operates in various uses will now be described in relation to FIGS. 14 to 19.

Figure 14:
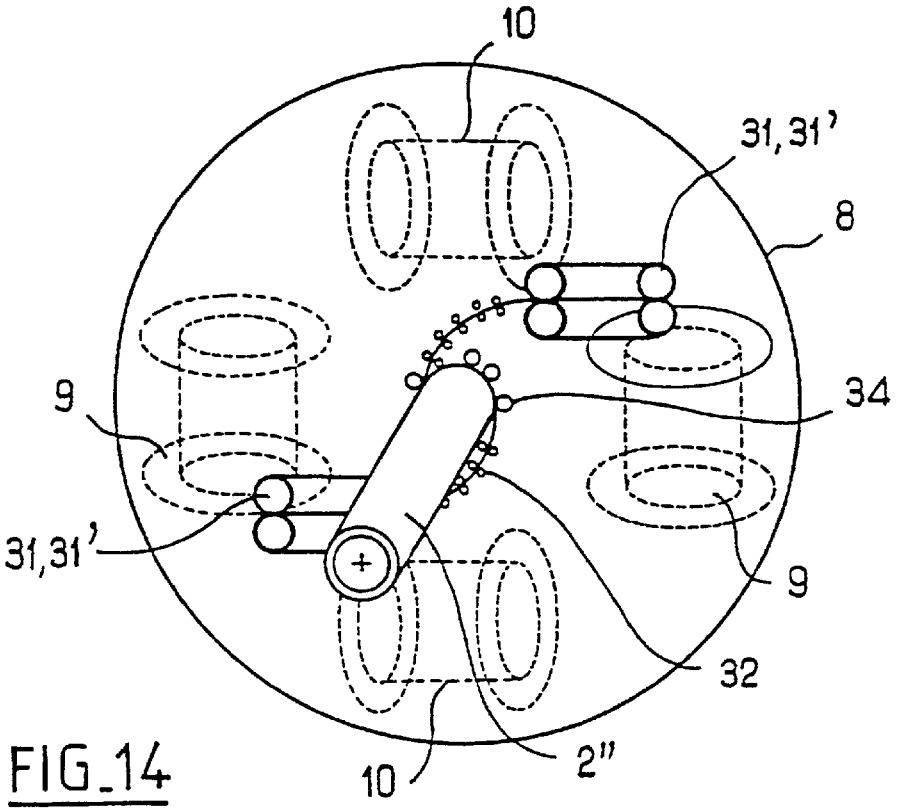
FIG. 14 is a diagram showing the arrangement of the cage and of the reels, allowing the wire-spiralling machine to be used in various modes.

FIG. 14 depicts the cage 8 and its on-board twin-track caterpillars 31, 31'. Sketched to the rear of the cage 8 are the east and west reels 9 and the north and south reels 10.

In a first typical use for the spiralling of large cross section noninterlocking shaped wire, there are two possible scenarios depending on whether the wire is locked by a locking wire which is different in nature to the wire (locking wire in the proper meaning of the term) or of the same nature as the wire (that is to say using another shaped wire arranged the other way round).

In the first case, the reels 9 hold the shaped wire, while the reels 10 hold the locking wire.

In the second case, only the reels 9 are used and respectively hold the first shaped wire and the second wire arranged the other way round.

In a second use of the wire-spiralling machine of the invention, a binding layer is spiral-wound: the reels 10 then hold the flat binding wire.

In a third use, the spiralling machine allows spiralled strips of thermal insulation, held on the reels 10, or perhaps 9, to be wound.

Figure 15:
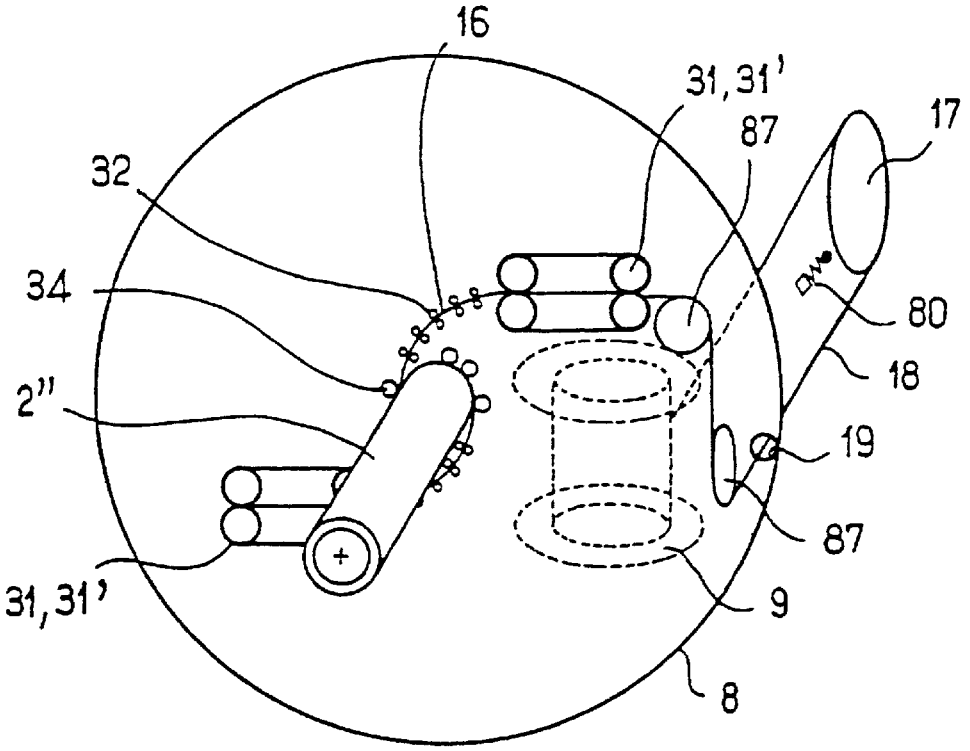
FIG. 15 is a diagram showing the circuit taken by the shaped wire through the wire-spiralling machine of the invention.

The diagram of FIG. 15 shows the path of the noninterlocking wire 16 from the reel 9 to the turner 17 adjusted by the ram 80, and then downstream through the openings 19 towards the turning devices 87 which lead it on to the entry of the twin-track caterpillar 31, 31', from where it emerges to pass between the guiding/bending rolls 32, 83 and the press rolls 34 to form the flexible tube 2".

Figure 16:
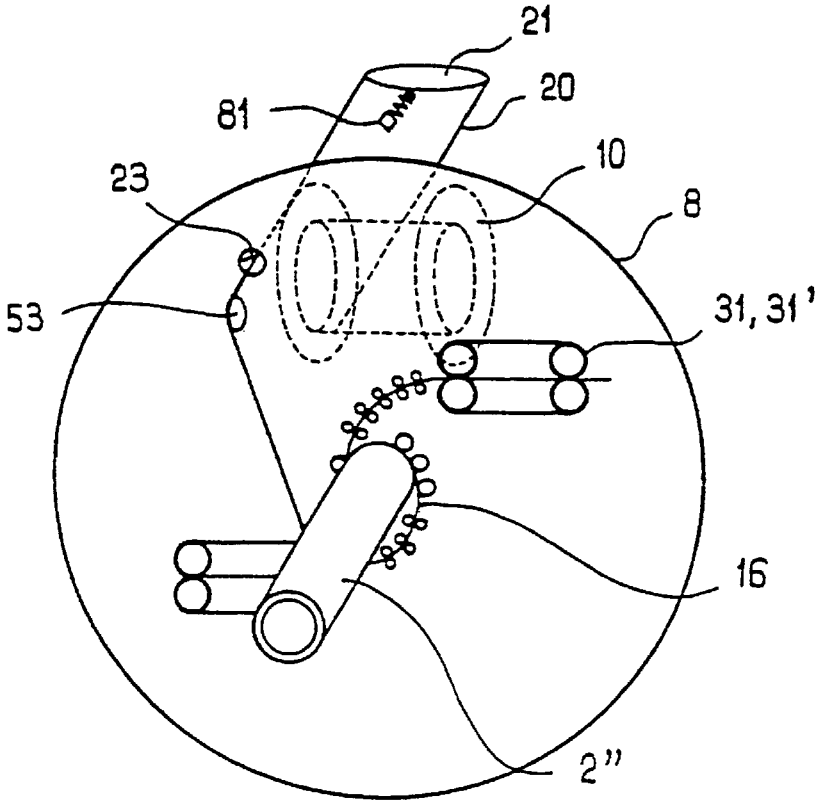
FIG. 16 is a diagram showing the circuit taken by the binding wire or the locking wire through the wire-spiralling machine of the invention.

The diagram of FIG. 16 shows the path of a binding wire or of the locking wire 20 from the reels 10 towards the turner 21 acted upon by the ram 81, then downstream towards the turner 53 and the lay point.

Figure 17:
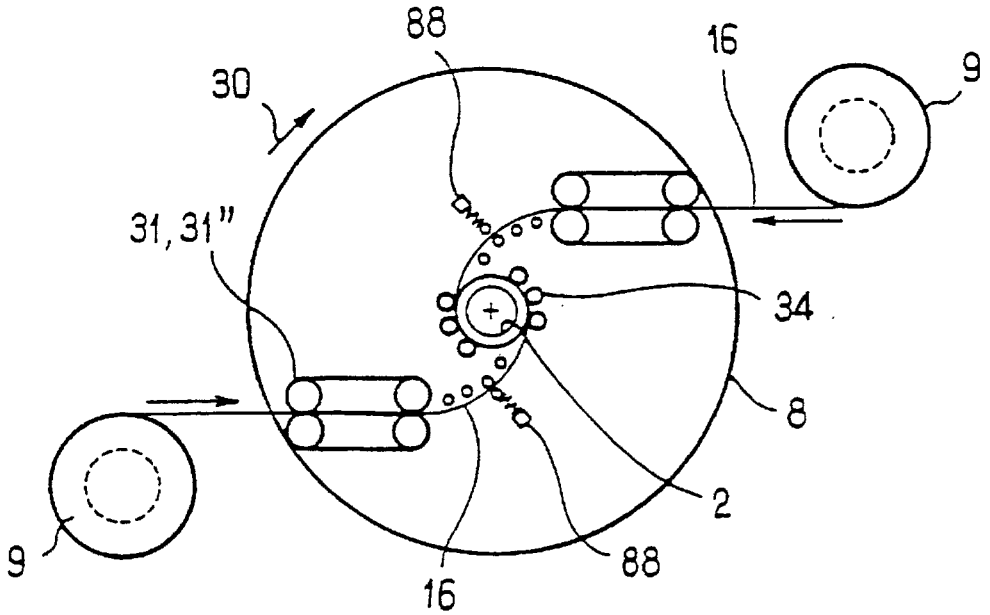
FIG. 17 is a diagram showing the pulled-wire mode of operation of the wire-spiralling machine of the invention for producing a pressure-armour layer in a rough bore pipe.

FIG. 17 explains the operation of the wire-spiralling machine with pulled wire. In this diagram and the two subsequent diagrams, the reels of wire 9 which are situated at the rear of the cage 8 have been depicted to the side to make the drawing more simple to understand. In the case depicted, the question is one of depositing a winding of shaped wire over a hard core of flexible tube 2 (which does not rotate with the cage 8, but which advances longitudinally). The typical application thereof is the construction of a pressure-armour layer on the hard core of a rough bore pipe using a noninterlocking shaped wire 16. The speed of the twin-track caterpillars 31, 31' is regulated by the signal from a sensor 88 sensing the positioning of the wire between the twin-track caterpillars 31, 31' and the lay point; the sensor 88 slaves the wire to a certain position, and therefore a certain tension range in the known way (see U.S. Pat. No. 4,895,011), that is to say keeps the tension in the wire 16 over this portion of the path prior to laying at a value that is compatible with the crushing strength of the hard core of the flexible tube 2.

Figure 18:
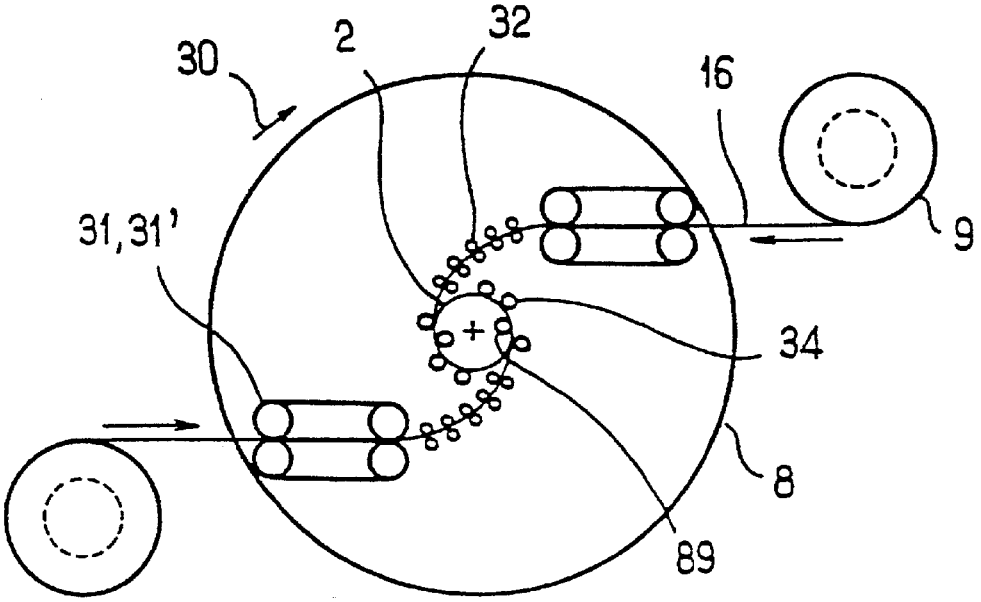
FIG. 18 is a diagram showing the pushed-wire mode of operation of the wire-spiralling machine of the invention, for producing a first layer in a rough bore pipe.

In FIG. 18, the question is one of spiral-winding a pushed wire to form the first layer of a rough bore pipe, that is to say a crush-resisting carcass which replaces the conventional interlocked strip for uses at high internal pressure and/or great depth. Since the device is forming a first layer without a support, it is necessary to provide backing rolls 89 inside the flexible tube that is to be formed, these rolls cooperating with the bend rollers 34. The rollers 32 themselves are used merely for guiding the wire 16 between the exit from the twin-track caterpillar and the bend rollers 34 located near the lay point.

Figure 19:
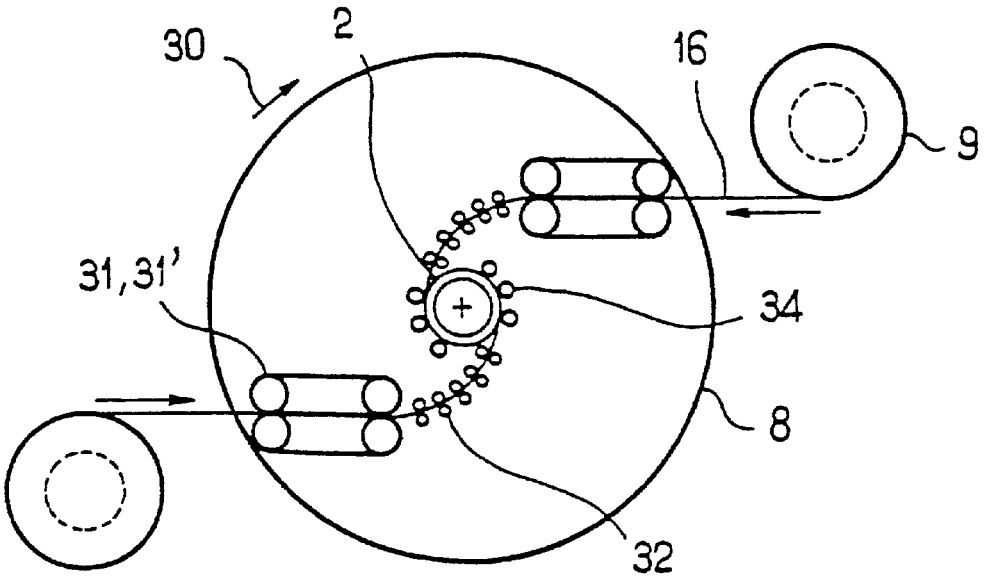
FIG. 19 is a diagram showing the pushed-wire mode of operation of the wire-spiralling machine of the invention, for producing a pressure-armour layer in a smooth bore pipe.

FIG. 19 finally shows diagrammatically the spiral-winding with pushed wire to form a pressure-armour layer on a sealed plastic internal sheath of a smooth bore pipe.

We claim:

1. A device for producing a tubular structure including a spiral winding made of at least one shaped wire delivered from a first reel of wire having noninterlocking wire and a second reel of locking wire delivered from a reel of locking wire, said device comprising:

motorized circular cage rotating about a horizontal axis with which a longitudinal axis of said tubular structure coincides, said tubular structure being formed at a point located near to a downstream face of the cage; and a driver which longitudinally drags said tubular structure;

said first reel of wire and said second reel of locking wire being loaded on said cage and rotate with said cage; and a face of said cage supporting at least one on-board linear tensioner, said tensioner drags wire delivered from said first reel of wire, and said tensioner being interposed between said first reel of wire and a lay point at which said tubular structure is laid.

2. The device according to claim 1, further comprising:

at least one roll which guides and bends at least one of said noninterlocking and said locking wire, said at least one roll being supported on said face of said cage and being interposed between said linear tensioner and said lay point.

3. The device according to claim 1, wherein said cage has a central passage through which passes a flexible tube, said tubular structured being laid at a periphery of said flexible tube.

4. The device according to claim 1, wherein said cage is secured on an upstream face to a coaxial tube which supports said first reel wire and said second reel of locking wire.

5. The device according to claim 1, wherein:

said cage has at least one plate which is disposed on a front face of said cage and is inclined thereto said plate supporting said linear tensioner and said cage further comprises at least one presser in contact with at least one of said locking and said interlocking wire, said presser being interposed between said linear tensioner and said lay point.

6. The device according to claim 1, wherein said linear tensioner is a twin-track caterpillar.

7. The device according to claim 4, wherein said cage has openings for passage of said noninterlocking wire and said locking wire from said upstream face to a downstream face.

8. The device according to claim 5, wherein said device has two wires and two corresponding linear tensioners, each borne by one of two of said plates inclined in opposite directions.

9. The according to claim 5, wherein said inclination of at least one of said plates is adjustable.

10. The device according to claim 8, wherein each of said plates is in the shape of a crescent partially surrounding said tubular structure over at least 180°, ends of the two crescents nestling together in such a way as to envelop an inserted tube as two symmetric sectors.

11. A wire spiraling machine for producing a spiraling wire about a workpiece, said wire spiraling machine comprising:

a first reel of wire having a first wire;

a cage which rotates about a horizontal axis, said horizontal axis corresponding to a longitudinal axis of said workpiece;

a drive which conveys said workpiece through said cage; and a linear tensioner which drags said first wire delivered from said first reel thereby affecting a tension of said first wire as applied to said workpiece.

12. The wire spiraling machine as claimed in claim 11, further comprising:

a second reel of wire having second wire; and an additional linear tensioner which drags said second wire delivered from said second reel thereby affecting a tension of said second wire as applied to said workpiece.

13. The wire spiraling machine as claimed in claim 11, wherein said workpiece is a flexible tube.

14. The wire spiraling machine as claimed in claim 11, further comprising at least one presser which presses said first wire against said workpiece.

15. The wire spiraling machine as claimed in claim 11, further comprising at least one roll which guides and bends said first wire, said at least one roll being disposed upon said cage.

16. The wire spiraling machine as claimed in claim 11, wherein at least one of said first and second wire is a locking wire.

17. The wire spiraling machine as claimed in claim 11, wherein:

said linear tensioner is supported on a plate, said plate being mounted on said cage; and said plate is inclined relative to said cage.

18. The wire spiraling machine as claimed in claim 17, wherein said inclination is adjustable.

19. The wire spiraling machine as claimed in claim 17, further comprising:

a second reel of wire having second wire;

an additional linear tensioner which drags said second wire delivered from said second reel thereby affecting a tension of said second wire as applied to said workpiece; and said additional linear tensioner is disposed on an additional plate;

wherein said plates are in the shape of a crescent, each of said plates partially surrounding said workpiece whereby a combination of said plates envelops said workpiece.

* * * * *